US009874188B2

(12) United States Patent
Ito et al.

(10) Patent No.: US 9,874,188 B2
(45) Date of Patent: Jan. 23, 2018

(54) FUEL INJECTION VALVE

(71) Applicants: TOYOTA JIDOSHA KABUSHIKI KAISHA, Toyota-shi, Aichi-ken (JP); KABUSHIKI KAISHA TOYOTA JIDOSHOKKI, Kariya-shi, Aichi-ken (JP)

(72) Inventors: Hisaki Ito, Gotenba (JP); Noriyuki Takada, Susono (JP); Tsutomu Kawae, Kariya (JP)

(73) Assignees: Toyota Jidosha Kabushiki Kaisha, Toyota-shi, Aichi-ken (JP); Kabushiki Kaisha Toyota Jidoshokki, Kariya-shi, Aichi-ken (JP)

( * ) Notice: Subject to any disclaimer, the term of this patent is extended or adjusted under 35 U.S.C. 154(b) by 28 days.

(21) Appl. No.: 14/933,393

(22) Filed: Nov. 5, 2015

(65) Prior Publication Data

US 2016/0131098 A1 May 12, 2016

(30) Foreign Application Priority Data

Nov. 7, 2014 (JP) ..... 2014-227314

(51) Int. Cl.
*F02M 61/18* (2006.01)

(52) U.S. Cl.
CPC ..... *F02M 61/1833* (2013.01); *F02M 61/182* (2013.01); *F02M 61/1846* (2013.01)

(58) Field of Classification Search
CPC ..... F02M 61/1833; F02M 61/182; F02M 61/162; F02M 61/163; F02M 61/1806; F02M 61/1846; F02M 61/186
(Continued)

(56) References Cited

U.S. PATENT DOCUMENTS 5,163,621 A * 11/1992 Kato ..... F02M 61/163 239/533.12
6,345,601 B1 2/2002 Miyajima et al.
(Continued)

FOREIGN PATENT DOCUMENTS

JP 2008-014216 1/2008
JP 2010-048237 3/2010
(Continued)

*Primary Examiner* — Arthur O Hall
*Assistant Examiner* — Alexander Valvis
(74) *Attorney, Agent, or Firm* — Finnegan, Henderson, Farabow, Garrett & Dunner, LLP

(57) ABSTRACT

An object of the present invention is to further improve the characteristic of the fuel spray of a fuel injection valve which has a plurality of stepped injection holes having a hole diameter of an outlet side injection hole larger than a hole diameter of an inlet side injection hole and which injects fuel from the stepped injection holes into a cylinder of an internal combustion engine. A cutout portion, which guides a flow of gas flowing into an outlet side injection hole from a lateral position of a fuel outlet of the outlet side injection hole during fuel injection, in a circumferential direction of the outlet side injection hole, is provided for at least one of both lateral portions between which the fuel outlet is interposed along with an arrangement direction of a plurality of injection holes, on a circumferential edge of the fuel outlet of the outlet side injection hole, in relation to at lease some of the injection holes of a fuel injection valve having the plurality of stepped injection holes.

4 Claims, 9 Drawing Sheets

(58) Field of Classification Search
USPC ..... 239/533.12, 562
See application file for complete search history.

(56) References Cited

U.S. PATENT DOCUMENTS

| | | | | |
|---|---|---|---|---|
| 7,066,408 | B2 * | 6/2006 | Sugimoto | F02M 61/162 239/461 |
| 7,234,654 | B2 * | 6/2007 | Holzgrefe | F02M 61/1833 239/499 |
| 8,402,655 | B2 * | 3/2013 | Higuma | B21J 5/10 239/533.3 |
| 8,905,333 | B1 * | 12/2014 | Sykes | F02M 61/1806 239/5 |
| 9,303,608 | B2 * | 4/2016 | Kaneta | F02M 61/1806 |
| 2009/0272824 | A1 * | 11/2009 | Kitagawa | F02M 51/061 239/585.5 |
| 2014/0224214 | A1 | 8/2014 | Vorbach | |
| 2015/0377200 | A1 | 12/2015 | Abe et al. | |

FOREIGN PATENT DOCUMENTS

| | | | |
|---|---|---|---|
| JP | 2014-148955 | A | 8/2014 |
| JP | 2014-518986 | A | 8/2014 |
| JP | 2014-206048 | A | 10/2014 |
| WO | WO 2014/167395 | A1 | 10/2014 |

* cited by examiner

FUEL INJECTION VALVE

BACKGROUND OF THE INVENTION

Field of the Invention

The present invention relates to a fuel injection valve for injecting fuel into a cylinder of an internal combustion engine.

Description of the Related Art

Conventionally, a technique is known, in which an injection hole of a fuel injection valve for injecting fuel into a cylinder of an internal combustion engine is constructed such that a step (difference in diameter) is formed on a wall surface at a boundary between an inlet side injection hole and an outlet side injection hole so that a hole diameter of the outlet side injection hole as a portion disposed on a fuel outlet side (i.e., on an outer side of the fuel injection valve) is larger than a hole diameter of the inlet side injection hole as a portion disposed on a fuel inlet side (i.e., on an inner side of the fuel injection valve) (see, for example, Patent Literature 1). The injection hole, which is constructed such that the step as described above is formed on the wall surface at the boundary between the inlet side injection hole and the outlet side injection hole, is hereinafter referred to as "stepped injection hole" in some cases.

Another fuel injection valve is also developed, which is constructed such that a tapered portion is provided on a fuel inlet side of an injection hole, and a helical groove is provided on an inner wall surface of the injection hole (see, for example, Patent Literature 2).

CITATION LIST

Patent Literature

Patent Literature 1: Japanese Patent Application Laid-Open No. 2008-014216

Patent Literature 2: Japanese Patent Application Laid-Open No. 2010-048237

SUMMARY OF THE INVENTION

Technical Problem

An object of the present invention is to further improve the characteristic of the fuel spray of a fuel injection valve which has a plurality of stepped injection holes and which injects fuel from the stepped injection holes into a cylinder of an internal combustion engine.

Solution to Problem

The present invention resides in a fuel injection valve having a plurality of stepped injection holes for injecting fuel from the stepped injection holes into a cylinder of an internal combustion engine, wherein a cutout portion, which guides a flow of gas flowing into an outlet side injection hole from a lateral position of a fuel outlet during fuel injection, in a circumferential direction of the outlet side injection hole, is provided on a circumferential edge of the fuel outlet of the outlet side injection hole. Note that in this specification, the positions, which are disposed on the both sides and between which the fuel outlet is interposed along with the arrangement direction of the plurality of injection holes, are referred to as "lateral (positions)" of the fuel outlet, in relation to the fuel outlet of the outlet side injection hole. Further, the arrangement direction of the plurality of injection holes is defined as "left-right direction" in relation to the fuel outlet of the outlet side injection hole. Further, the direction, which is directed to the forward end (tip) side of the fuel injection valve in the axial direction of the fuel injection valve, is defined as "downward direction", and the direction, which is directed to the side opposite to the forward end side in the axial direction of the fuel injection valve, is defined as "upward direction", in relation to the fuel outlet of the outlet side injection hole.

More specifically, the fuel injection valve according to the present invention resides in a fuel injection valve having a plurality of injection holes arranged so that the plurality of injection holes are aligned on a circumference at a forward end (tip) portion of a main nozzle body, for injecting fuel from the injection holes into a cylinder of an internal combustion engine; the injection hole having a step which is formed on a wall surface at a boundary between an inlet side injection hole and an outlet side injection hole so that a hole diameter of the outlet side injection hole as a portion disposed on a fuel outlet side is larger than a hole diameter of the inlet side injection hole as a portion disposed on a fuel inlet side; wherein a cutout portion, which guides a flow of gas flowing into the outlet side injection hole from a lateral position of a fuel outlet of the outlet side injection hole during fuel injection, in a circumferential direction of the outlet side injection hole, is provided for at least one of both lateral portions between which the fuel outlet is interposed along with an arrangement direction of the plurality of injection holes, on a circumferential edge of the fuel outlet of the outlet side injection hole, in relation to at least some of the injection holes.

In the case of the stepped injection hole which is formed so that the hole diameter of the outlet side injection hole is larger than the hole diameter of the inlet side injection hole, the spraying angle (spreading angle of the spray) of the fuel spray begins to spread at the point in time at which the fuel spray is spouted from the inlet side injection hole to the outlet side injection hole. On this account, the spraying angle of the fuel spray injected from each of the injection holes can be further expanded as compared with a case in which the hole diameter of the outlet side injection hole is the same as the hole diameter of the inlet side injection hole.

Further, in the case of the stepped injection hole constructed as described above, when the fuel injection pressure is relatively high, the pressure drop occurs in the vicinity of the side wall surface in the outlet side injection hole, when the fuel is injected from the injection hole. As a result, the gas (air), which exists around the fuel outlet of the outlet side injection hole in the combustion chamber, is drawn into the outlet side injection hole. When the inflow of the gas into the outlet side injection hole as described above occurs during the fuel injection, the mixing is thereby facilitated between the fuel and the air in the fuel spray. Further, when the gas flows into the space disposed in the vicinity of the side wall surface in the outlet side injection hole during the fuel injection, the gas suppresses the diffusion of the fuel existing in the vicinity of the central axis of the fuel spray injected from each of the injection holes, from the surroundings of the central axis. Therefore, when the fuel injection pressure is relatively high, it is also possible to improve the penetration of the fuel spray.

In this context, as for the stepped injection hole, when the gas (air), which exists around the fuel outlet of the outlet side injection hole during the fuel injection, is drawn into the outlet side injection hole, the gas, which exists in the space positioned between the mutually adjoining injection holes, is drawn into both of the mutually adjoining injection holes. However, the volume of the gas existing in the space positioned between the injection holes is limited. On this account, any sufficient amount of the gas hardly flows into the outlet side injection hole from the lateral position of the fuel outlet.

In view of the above, in the present invention, the cutout portion, which guides the flow of the gas flowing into the outlet side injection hole from the lateral position of the fuel outlet of the outlet side injection hole during the fuel injection, in the circumferential direction of the outlet side injection hole, is provided for at least one of the both lateral portions between which the fuel outlet is interposed along with the arrangement direction of the plurality of injection holes, on the circumferential edge of the fuel outlet of the outlet side injection hole, in relation to at least some of the injection holes. According to the construction as described above, the flow of the gas flowing into the outlet side injection hole during the fuel injection is guided in the circumferential direction of the outlet side injection hole, and thus the swirling flow of the gas is generated in the outlet side injection hole. Then, the flow of the gas, which is directed in the tangential direction of the circumferential edge of the fuel outlet, is generated at the lateral position of the fuel outlet. When the flow of the gas is generated as described above, the gas, which exists at the upward or downward position with respect to the space disposed between the mutually adjoining injection holes, is thereby drawn into the space disposed between the injection holes. As a result, not only the gas existing in the space disposed between the mutually adjoining injection holes but also the gas existing at the upward or downward position with respect to the space disposed between the injection holes easily flows into the outlet side injection hole from the lateral position of the fuel outlet. In other words, the inflow of the gas from the lateral position of the fuel outlet into the outlet side injection hole is facilitated.

Therefore, according to the present invention, when the fuel injection pressure is relatively high, it is possible to incorporate a larger amount of the gas into the outlet side injection hole during the fuel injection. On this account, it is possible to further facilitate the mixing of the fuel and the air. Further, the fuel, which exists in the vicinity of the central axis of the fuel spray injected from each of the injection holes, is more suppressed from being diffused from the surroundings of the central axis. On this account, it is possible to further improve the penetration of the fuel spray injected from each of the injection holes when the fuel injection pressure is relatively high. As a result, it is possible to utilize a larger amount of the air existing in the combustion chamber for the combustion of the fuel.

In the present invention, it is also preferable that the cutout portion extends upwardly or downwardly along the circumferential edge from a central side of the lateral portion at the lateral portion of the circumferential edge of the fuel outlet of the outlet side injection hole, and the cutout portion is formed so that a width thereof is gradually decreased at positions separated farther along the circumferential edge from the central side of the lateral portion on the circumferential edge of the fuel outlet and a bottom surface thereof forms an inclined surface which gradually approaches a step surface of the boundary between the inlet side injection hole and the outlet side injection hole at positions separated farther along the circumferential edge from the central side of the lateral portion on the circumferential edge of the fuel outlet (i.e., an inclined surface which is inclined toward the inside of the injection hole). When the gas, which flows into the outlet side injection hole from the lateral position of the fuel outlet during the fuel injection, flows along the cutout portion formed as described above, the flow of the gas is thereby guided in the circumferential direction of the outlet side injection hole.

Further, in the present invention, when the cutout portions are provided for both of the mutually adjoining injection holes, it is also preferable that the cutout portions, which are provided for the mutually adjoining injection holes respectively, are formed so that the flows of the gas flowing into the respective outlet side injection holes during the fuel injection are guided in mutually opposite directions in the circumferential directions of the outlet side injection holes. For example, when the cutout portions are formed as described above, and the cutout portions are provided for both of the mutually confronting lateral portions on the circumferential edges of the respective fuel outlets of the mutually adjoining injection holes, then it is also preferable that the cutout portions, which are provided for the mutually adjoining injection holes respectively, extend in an identical direction along the circumferential edges from the central sides of the lateral portions of the circumferential edges of the fuel outlets. When the cutout portions as described above are provided, the gas, which flows into the outlet side injection holes during the fuel injection in relation to the mutually adjoining injection holes respectively, is guided in the mutually opposite directions in the circumferential directions of the outlet side injection holes. According to the construction as described above, the counterclockwise swirling flow is generated in one injection hole of the mutually adjoining injection holes, and the clockwise swirling flow is generated in the other injection hole. In the meantime, if the cutout portions, which are provided for the mutually adjoining injection holes respectively, are formed so that the flows of the gas flowing into the respective outlet side injection holes are guided in a mutually identical direction in the circumferential directions of the outlet side injection holes, the swirling flow in the same direction is generated in each of the mutually adjoining injection holes. If such a situation occurs, both of the flow of the gas directed from the upward to the downward and the flow of the gas directed from the downward to the upward are generated in the space disposed between the mutually adjoining injection holes. On this account, the forces, which intend to draw the gas from both of the upward and the downward, act on the one space disposed between the mutually adjoining injection holes. In this case, the gas, which is drawn from the upward of the space disposed between the injection holes, mutually collides with the gas which is drawn from the downward of the space disposes between the injection holes. Therefore, it is feared that the gas may hardly flow thereinto. On the contrary, in the case of the construction described above, the swirling flows, which are directed in the mutually opposite directions, are generated in the respective outlet side injection holes of the mutually adjoining injection holes. Then, any one of the flow of the gas directed from the upward to the downward and the flow of the gas directed from the downward to the upward is generated in the one space disposed between the mutually adjoining injection holes. On this account, the gas is drawn from any one of the upward and the downward into the one space disposed between the injection holes. Therefore, it is possible to further facilitate the inflow of the gas into the outlet side injection hole from the lateral position of the fuel outlet.

Further, in the present invention, when the cutout portions are provided for both of the mutually adjoining injection holes, it is also preferable that the cutout portion is provided on any specified one of a left side and a right side between which the fuel outlet is interposed along with the arrangement direction of the plurality of injection holes, on the circumferential edge of the fuel outlet of the outlet side injection hole in relation to each of the mutually adjoining injection holes.

Even when the cutout portion is provided on only any one of the left side and the right side between which the fuel outlet is interposed along with the arrangement direction of the plurality of injection holes, on the circumferential edge of the fuel outlet as described above, then the swirling flow of the gas can be generated in the outlet side injection hole, and the flow of the gas flowing in the tangential direction of the circumferential edge of the fuel outlet can be generated at the lateral position of the fuel outlet. However, when the cutout portion is provided on only any one of the left side and the right side on the circumferential edge of the fuel outlet, if the construction is made such that the cutout portion is provided at the right side portion of the circumferential edge of the fuel outlet of the outlet side injection hole in one injection hole of the mutually adjoining injection holes, and the cutout portion is provided at the left side portion of the circumferential edge of the fuel outlet of the outlet side injection hole in the other injection hole, then such a portion appears that the lateral portions in relation to the mutually adjoining injection holes respectively, at each of which the cutout portion on the circumferential edge of the fuel outlet is not provided, are confronted with each other. At the portion as described above, when the gas, which exists around the fuel outlet of the outlet side injection hole during the fuel injection, is drawn into the outlet side injection hole, the flow of the gas flowing in the tangential direction of the circumferential edge of the fuel outlet is hardly generated. In other words, the inflow of the gas into the outlet side injection hole from the lateral position of the fuel outlet is hardly facilitated.

In view of the above, as described above, when the cutout portion is provided for only any one of the left side and the right side of the circumferential edge of the fuel outlet in relation to the mutually adjoining injection holes, the position, at which the cutout portion is provided, is one specified side. In other words, the construction is made such that when the cutout portion is provided at the right side portion of the circumferential edge of the fuel outlet for one injection hole of the mutually adjoining injection holes, the cutout portion is also provided at the right side portion of the circumferential edge of the fuel outlet for the other injection hole. Further, the construction is made such that when the cutout portion is provided at the left side portion of the circumferential edge of the fuel outlet for one injection hole of the mutually adjoining injection holes, the cutout portion is also provided at the left side portion of the circumferential edge of the fuel outlet for the other injection hole. According to the construction as described above, the cutout portion is provided for any one of the respective lateral portions on the circumferential edges of fuel outlets of the mutually confronting outlet side injection holes, in relation to the mutually adjoining injection holes. On this account, the inflow of the gas into the outlet side injection hole from the lateral position of the fuel outlet can be facilitated at a preferred balance. Therefore, it is possible to more appropriately improve the penetration of the fuel spray when the fuel injection pressure is relatively high.

Advantageous Effects of Invention

According to the present invention, it is possible to further improve the characteristic of the fuel spray of the fuel injection valve which has the plurality of stepped injection holes and which injects the fuel from the stepped injection holes into the cylinder of the internal combustion engine.

Further features of the present invention will become apparent from the following description of exemplary embodiments with reference to the attached drawings.

DESCRIPTION OF THE EMBODIMENTS

An explanation will be made below on the basis of the drawings about a specified embodiment of the present invention. For example, the dimension or size, the material, the shape, and the relative arrangement of each of constitutive parts or components described in the embodiment of the present invention are not intended to limit the technical scope of the invention only thereto unless specifically noted.

First Embodiment

In this section, an explanation will be made as exemplified by a case in which the present invention is applied to a fuel injection valve for a diesel engine for driving a vehicle. Note that the internal combustion engine according to the present invention is not limited to the diesel engine, which may be a gasoline engine.

Figure 1:
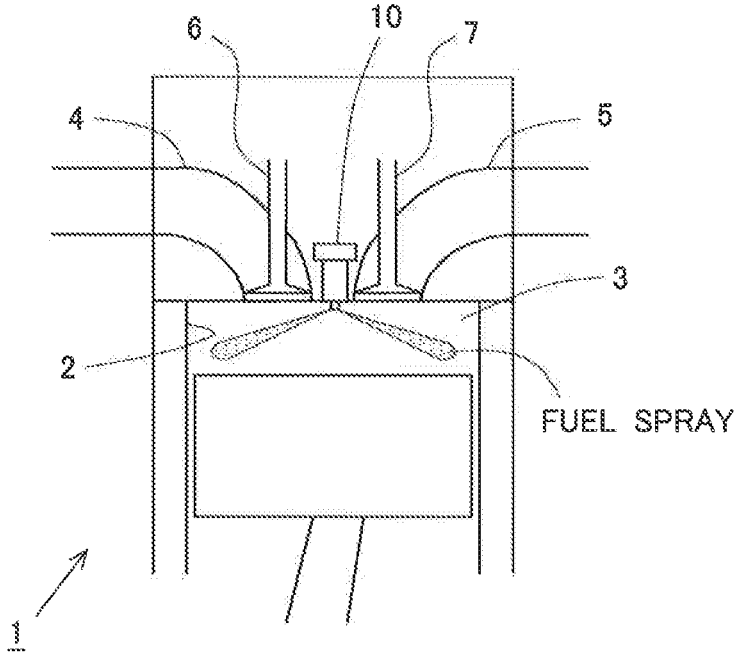
FIG. 1 shows a schematic arrangement of an internal combustion engine according to a first embodiment.

FIG. 1 shows a schematic arrangement of the internal combustion engine according to this embodiment. The internal combustion engine 1 is the four-cycle diesel engine for driving the vehicle having four cylinders 2. Note that only one cylinder is shown in FIG. 1 for the purpose of convenience. An intake port 4 and an exhaust port 5 are connected to the cylinder 2. Opening portions of the intake port 4 and the exhaust port 5 with respect to a combustion chamber 3 are opened/closed by an intake valve 6 and an exhaust valve 7 respectively.

Figure 2A:
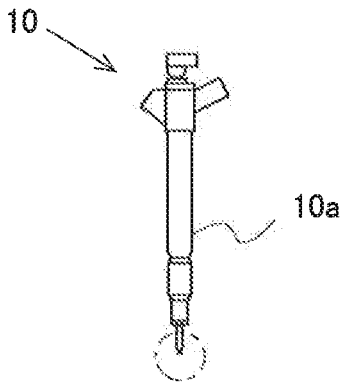
FIGS. 2A and 2B show schematics arrangement of a fuel injection valve according to the first embodiment.
Figure 2B:
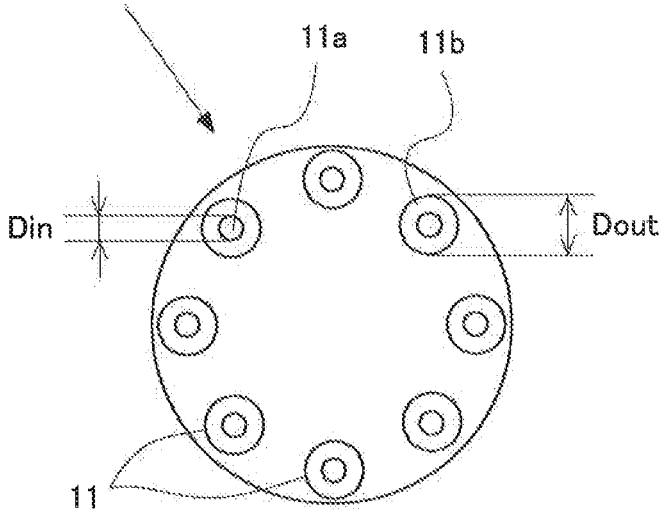

Further, the cylinder 2 is provided with a fuel injection valve 10 which injects the fuel into the cylinder 2. FIGS. 2A and 2B show schematics arrangement of the fuel injection valve 10. FIG. 2B is enlarged view of forward end portion of the fuel injection valve 10. Eight injection holes 11 are formed at a forward end portion of a main nozzle body 10*a* of the fuel injection valve 10 so that the injection holes 11 are aligned on a circumference. The fuel injection valve 10 is provided in the cylinder 2 so that the forward end portion protrudes into the combustion chamber 3 from a position disposed in the vicinity of the center of the upper wall surface of the combustion chamber 3. Then, the fuel is injected in the radial directions of the cylinder 2 from the respective injection holes of the fuel injection valve 10.

(Construction of Injection Hole)

Figure 3:
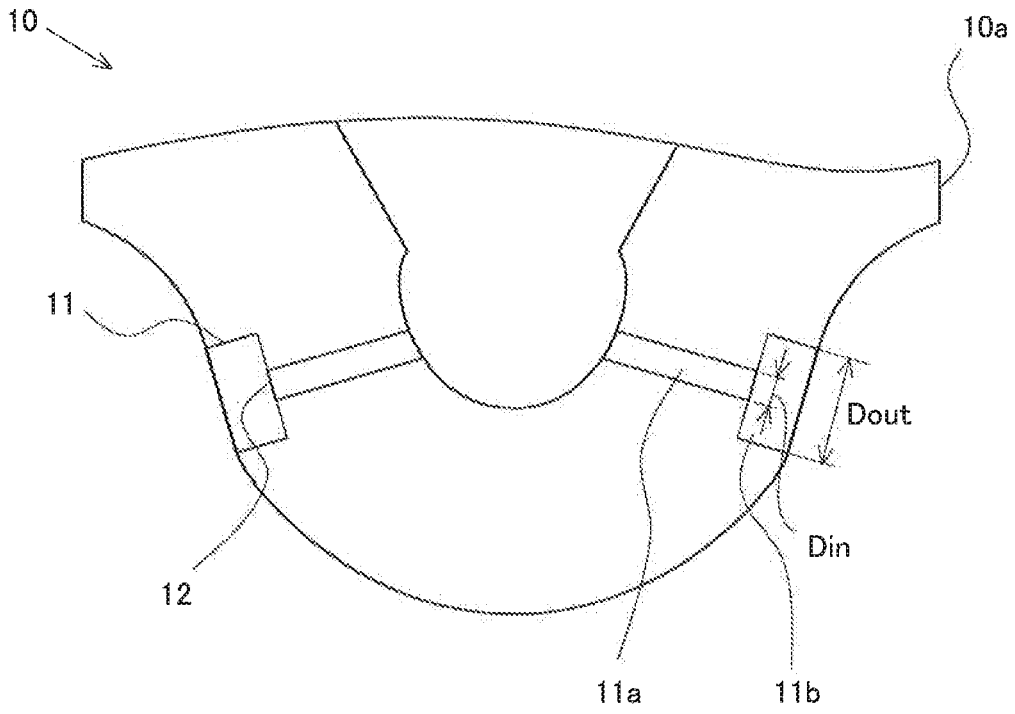
FIG. 3 shows a sectional view illustrating a forward end portion of the fuel injection valve according to the first embodiment.
Figure 4:
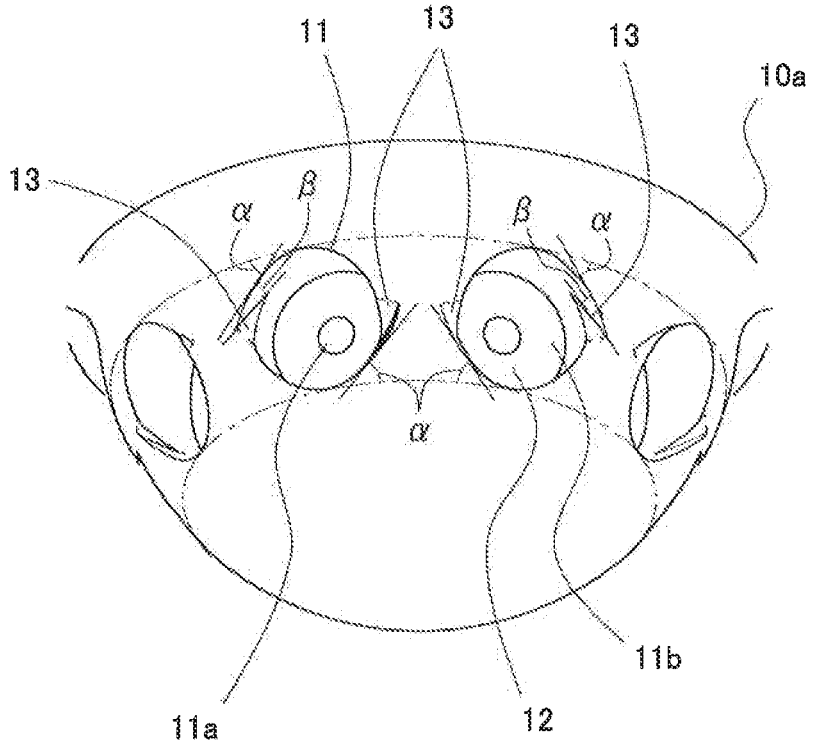
FIG. 4 shows a perspective view illustrating the forward end portion of the fuel injection valve according to the first embodiment.

An explanation will now be made on the basis of FIGS. 3 and 4 about the construction of each of the injection holes 11 of the fuel injection valve 10. FIG. 3 shows a sectional view illustrating the forward end portion of the fuel injection valve 10. FIG. 4 shows a perspective view illustrating the forward end portion of the fuel injection valve 10. As shown in FIG. 3, each of the injection holes 11 is a stepped injection hole in which the step (difference in diameter) is formed on the wall surface at the boundary between an inlet side injection hole 11*a* and an outlet side injection hole 11*b* so that the hole diameter Dout of the outlet side injection hole 11*b* as the portion disposed on the fuel outlet side (i.e., on the outer side of the fuel injection valve 10) is larger than the hole diameter Din of the inlet side injection hole 11*a* as the portion disposed on the fuel inlet side (i.e., on the inner side of the fuel injection valve 10)(Dout>Din).

In the injection hole 11, the inlet side injection hole 11*a* is open on a step surface for forming the step as the boundary between the inlet side injection hole 11*a* and the outlet side injection hole 11*b*. The fuel, which is injected from the injection hole 11, firstly passes through the inlet side injection hole 11*a*, and the fuel is spouted to the outlet side injection hole 11*b*. Subsequently, the fuel is spouted into the combustion chamber 3 from the fuel outlet of the outlet side injection hole 11*b*.

Further, as shown in FIG. 4, each of the injection holes 11 is provided with cutout portions 13 at two positions on the circumferential edge of the fuel outlet of the outlet side injection hole 11. The cutout portions 13 are provided on the both left and right sides (i.e., on the both lateral sides on the circumferential edge of the fuel outlet) between which the fuel outlet is interposed along with the arrangement direction of the plurality of injection holes 11, on the circumferential edge of the fuel outlet of the outlet side injection hole 11*b*. Then, one of the cutout portions 13 provided on the both left and right sides of the circumferential edge of the fuel outlet of one injection hole 11 extends upwardly along the circumferential edge from the central side of the lateral portion of the circumferential edge of the fuel outlet, and the other extends downwardly along the circumferential edge from the central side of the lateral portion of the circumferential edge of the fuel outlet.

Each of the cutouts 13 is formed so that the width thereof is gradually decreased at positions separated farther along the circumferential edge from the central side of the lateral portion of the circumferential edge of the fuel outlet. Further, each of the cutouts 13 is formed so that the bottom surface thereof forms an inclined surface which gradually approaches the step surface 12 as the boundary between the inlet side injection hole 11*a* and the outlet side injection hole 11*b* at positions separated farther along the circumferential edge from the central side of the lateral portion of the circumferential edge of the fuel outlet. With reference to FIG. 4, a represents the angle of inclination of the tangential line provided at the forward end portion (portion having the narrowest width) of the cutout portion 13 with respect to the tangential line provided at the upper end or the lower end of the fuel outlet of the outlet side injection hole 11*b*. In this embodiment, the angle of inclination $\alpha$ is 30 to 45 degrees. Further, with reference to FIG. 4, $\beta$ represents the angle of inclination of the bottom surface of the cutout portion 13 with respect to the circumferential edge of the fuel outlet of the outlet side injection hole 11*b*. In this embodiment, the angle of inclination $\beta$ is 10 to 30 degrees.

Further, as for the mutually adjoining injection holes 11, the arrangements and the shapes of the cutout portions 13 on the circumferential edges of the fuel outlets of the outlet side injection holes 11*b* are linearly symmetric. In other words, both of the cutout portions 13, which are provided at the mutually confronting positions on the circumferential edges of the respective fuel outlets of the mutually adjoining injection holes 11, extend in the identical direction in relation to the upward-downward direction along the circumferential edges.

[Effect of Construction of Injection Hole Described Above]

Figure 5:
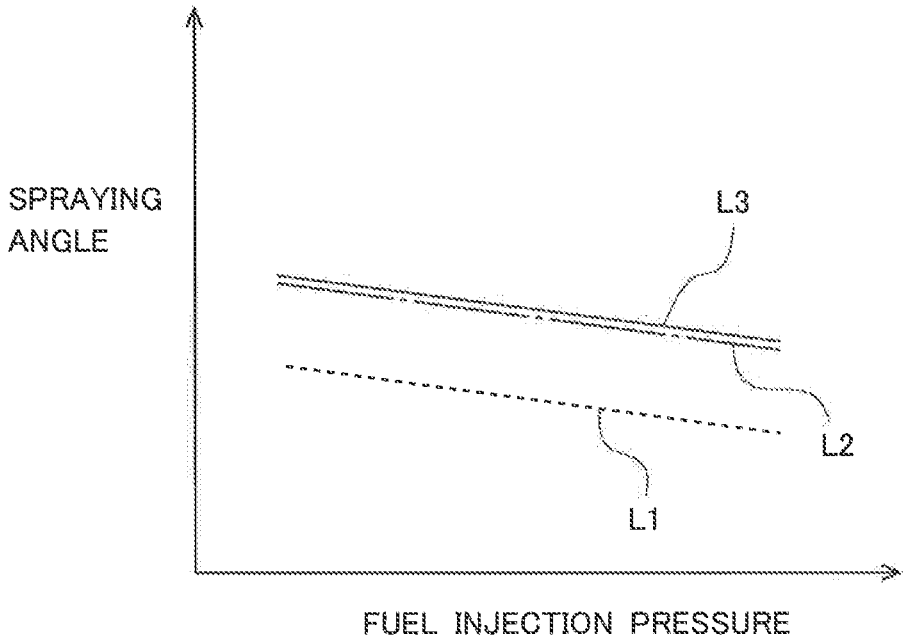
FIG. 5 shows a relationship between the fuel injection pressure and the spraying angle of the fuel spray injected from each of injection holes in relation to the fuel injection valve according to the first embodiment.

Next, an explanation will be made on the basis of FIGS. 5 to 9 about the effect of the construction of the injection hole according to this embodiment. FIG. 5 shows a relationship between the fuel injection pressure and the spraying angle of the fuel spray injected from one injection hole. With reference to FIG. 5, a broken line L1 shows a case of a conventional injection hole in which the hole diameter of an outlet side injection hole is the same as that of an inlet side injection hole without widening the outlet side injection hole (i.e., an injection hole which is not formed with any step: hereinafter referred to as "straight injection hole" in some cases), an alternate long and short dash line L2 shows a case of a stepped injection hole in which any cutout portion is not provided at the fuel outlet, and a solid line L3 shows a case of the stepped injection hole according to this embodiment, i.e., the stepped injection hole in which the cutout portion is provided at the fuel outlet.

In the case of the conventional straight injection hole, the spraying angle of the fuel spray begins to spread after spouting the fuel spray from the fuel outlet. On the contrary, in the case of the stepped injection hole, the spraying angle begins to spread at the point in time at which the fuel spray is spouted from the inlet side injection hole to the outlet side injection hole, before the fuel outlet. On this account, as shown in FIG. 5, in the case of the stepped injection hole, it is possible to expand the spraying angle of the fuel spray injected from each of the injection holes as compared with the straight injection hole. Note that with reference to FIG. 5, the spraying angle (L2) of the stepped injection hole which is not provided with the cutout portion is substantially equivalent to the spraying angle (L3) of the stepped injection hole which is provided with the cutout portion. According to this fact, it is surmised that the presence or absence of the cutout portion at the fuel outlet of the stepped injection hole hardly affects the spraying angle of the fuel spray injected from each of the injection holes.

Figure 6:
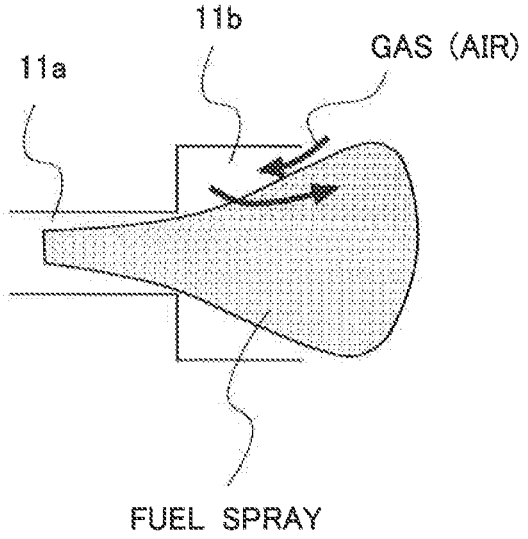
FIG. 6 shows a first drawing illustrating the flow of gas (air) around a fuel outlet of the injection hole during the fuel injection when the fuel injection pressure is relatively high according to the first embodiment.
Figure 7:
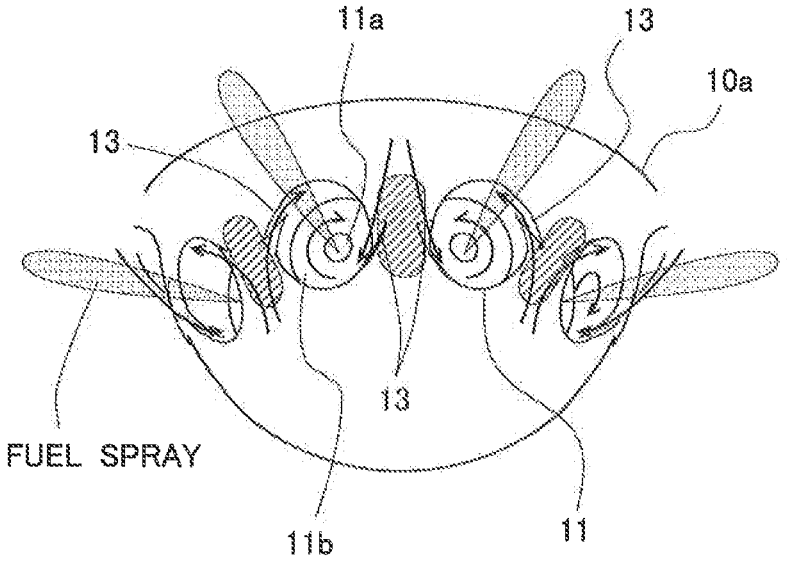
FIG. 7 shows a second drawing illustrating the flow of gas (air) around the fuel outlet of the injection hole during the fuel injection when the fuel injection pressure is relatively high according to the first embodiment.
Figure 8:
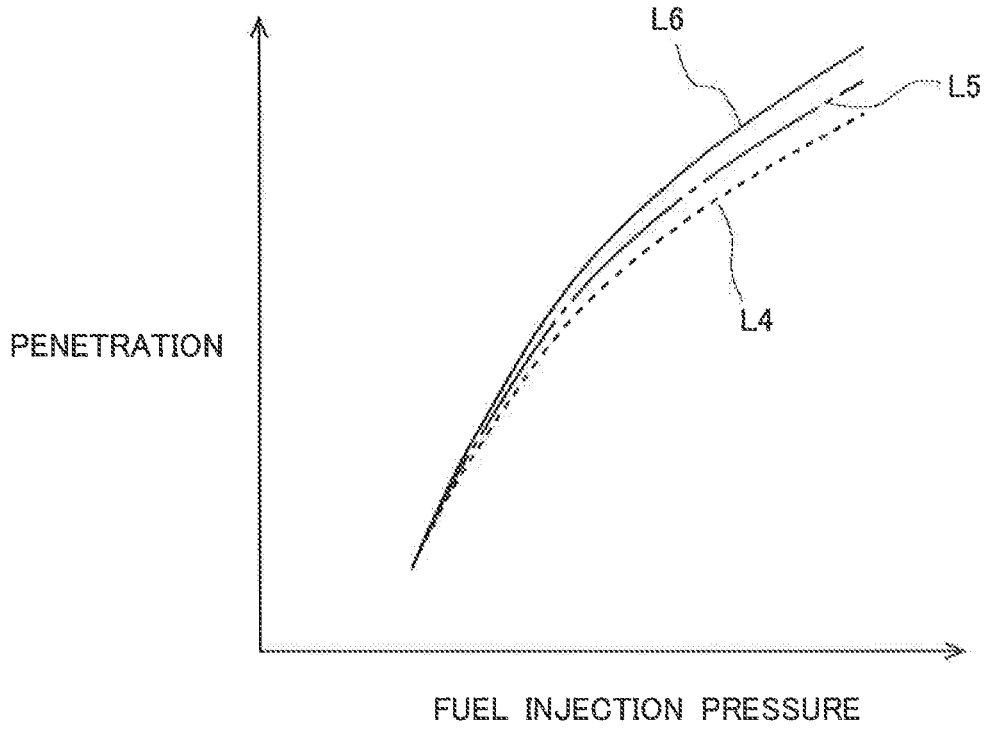
FIG. 8 shows a relationship between the fuel injection pressure and the penetration of the fuel spray injected from each of injection holes in relation to the fuel injection valve according to the first embodiment.

FIGS. 6 and 7 illustrate the flow of gas (air) around the fuel outlet of the injection hole during the fuel injection when the fuel injection pressure is relatively high. In FIGS. 6 and 7, the arrows indicate the flows of the gas during the fuel injection. Further, FIG. 8 shows a relationship between the fuel injection pressure and the penetration of the fuel spray. With reference to FIG. 8, a broken line L4 shows a case of the straight injection hole, an alternate long and short dash line L5 shows a case of the stepped injection hole in which any cutout portion is not provided at the fuel outlet, and a solid line L6 shows a case of the stepped injection hole according to this embodiment, i.e., the stepped injection hole in which the cutout portion is provided at the fuel outlet.

In the case of the stepped injection hole 11, when the fuel injection pressure is relatively high, the pressure drop occurs in the vicinity of the side wall surface in the outlet side injection hole 11*b* when the fuel is injected from the injection hole 11. As a result, as shown in FIG. 6, the gas, which exists around the fuel outlet of the outlet side injection hole 11*b* in the combustion chamber 3, is drawn into the outlet side injection hole 11*b*. When the inflow of the gas into the outlet side injection hole 11*b* as described above occurs during the fuel injection, the mixing of the fuel and the air in the fuel spray is facilitated thereby. Further, when the gas flows into the space disposed in the vicinity of the side wall surface in the outlet side injection hole 11*b* during the fuel injection, the gas functions so that the fuel spray injected from the injection hole 11 is restrained from the surroundings thereof. On this account, the fuel, which exists in the vicinity of the central axis of the fuel spray injected from each of the injection holes 11, is suppressed by the gas from being diffused from the surroundings of the central axis. On this account, the kinetic energy, which is possessed by the central axis portion of the fuel spray and which acts in the injection direction, is easily maintained. As a result, the penetration of the fuel spray is increased. Therefore, when the fuel injection pressure is relatively high, it is also possible to improve the penetration of the fuel spray as compared with the straight injection hole as shown in FIG. 8, while expanding the spraying angle of the fuel spray injected from each of the injection holes as compared with the straight injection hole as described above. In this situation, the higher the fuel injection pressure is, the larger the amount of the gas flowing into the outlet side injection hole resulting from the pressure drop is. On this account, the higher the fuel injection pressure is, the larger the extent of improvement in the penetration with respect to the case of the straight injection hole is.

Further, as shown in FIG. 8, according to this embodiment, when the cutout portion 13 as described above is provided on the circumferential edge of the fuel outlet of the stepped injection hole 11, it is thereby possible to improve the penetration at the higher fuel injection pressure as compared with the stepped hole in which the cutout portion is not provided. The reason thereof will be explained below.

As described above, in this embodiment, the plurality of stepped injection holes are arranged while being aligned on the circumference at the forward end portion of the main nozzle body 10*a*. In this case, when the gas (air), which exists around the fuel outlet of the outlet side injection hole during the fuel injection, is drawn into the outlet side injection hole, the gas, which exists in the space (area indicated by oblique lines in FIG. 7) positioned between the mutually adjoining injection holes, is drawn into both of the mutually adjoining injection holes. However, the volume of the gas existing in the space positioned between the injection holes as described above is limited. On this account, when the cutout portion is not provided at the fuel outlet, a sufficient amount of the gas hardly flows into the outlet side injection hole from the lateral positions of the fuel outlet as compared with the upward and downward positions of the fuel outlet.

On the contrary, in this embodiment, the cutout portion 13 as described above is provided on the circumferential edge of the fuel outlet of the outlet side injection hole 11*b*. Therefore, the gas, which flows into the outlet side injection hole 11*b* from the lateral position of the fuel outlet during the fuel injection, flows along the cutout portion 13. In this situation, the gas, which flows into the outlet side injection hole 11*b*, flows from the larger width portion toward the smaller width portion of the cutout portion 13. In other words, the flow of the gas flowing into the outlet side injection hole 11*b* from the lateral position of the fuel outlet is guided in the circumferential direction of the outlet side injection hole 11*b* by the cutout portion 13.

Then, the flow of the gas flowing into the outlet side injection hole 11*b* is guided in the circumferential direction of the outlet side injection hole 11*b*, and thus the swirling flow of the gas is generated in the outlet side injection hole 11*b* as shown in FIG. 7. Further, the flow of the gas, which is directed in the tangential direction of the circumferential edge of the fuel outlet, is generated at the lateral position of the fuel outlet of the outlet side injection hole 11*b*. When the flows of the gas are generated as described above, the gas, which exists at the upward or downward position with respect to the space disposed between the mutually adjoining injection holes, is thereby drawn into the space disposed between the injection holes. As a result, not only the gas existing in the space disposed between the mutually adjoining injection holes but also the gas existing at the upward or downward position of the space disposed between the injection holes easily flows into the outlet side injection hole 11*b* from the lateral position of the fuel outlet. In other words, the inflow of the gas into the outlet side injection hole 11*b* from the lateral position of the fuel outlet is facilitated.

Further, as described above, in this embodiment, the arrangements and the shapes of the cutout portions 13 on the circumferential edges of the fuel outlets of the outlet side injection holes 11*b* of the mutually adjoining injection holes 11 are linearly symmetric. On this account, as for the mutually adjoining injection holes 11, the flows of the gas flowing into the respective outlet side injection holes 11*b* are guided in the mutually opposite directions in the circumferential directions of the outlet side injection holes 11*b* by the cutout portions 13 provided for the mutually adjoining injection holes 11 respectively. Accordingly, in the mutually adjoining injection holes 11, the swirling flow in the counterclockwise direction is generated in one injection hole, and the clockwise swirling flow is generated in the other injection hole. Then, any one of the flow of the gas directed from the upward toward the downward and the flow of the gas directed from the downward toward the upward is generated in one space disposed between the mutually adjoining injection holes. In other words, it is possible to avoid such a situation that both of the flow of the gas directed from the upward toward the downward and the flow of the gas directed from the downward toward the upward are generated in one space disposed between the mutually adjoining injection holes, unlike such a case that the cutout portions, which are provided for the mutually adjoining injection holes respectively, guide the flows of the gas flowing into the respective outlet side injection holes in the mutually identical direction in the circumferential directions of the outlet side injection holes. On this account, the gas is drawn into one space disposed between the injection holes from any one of the upward position and the downward position thereof. Therefore, the inflow of the gas is hardly inhibited, and hence the inflow of the gas into the outlet side injection hole 11*b* from the lateral position of the fuel outlet is further facilitated.

As described above, according to this embodiment, the cutout portion 13 is provided on the circumferential edge of the fuel outlet of the outlet side injection hole 11*b*, and thus the inflow of the gas into the outlet side injection hole 11*b* from the lateral position of the fuel outlet is facilitated. On this account, a larger amount of the gas can be incorporated into the outlet side injection hole 11*b* during the fuel injection. On this account, it is possible to further facilitate the mixing of the fuel and the air. Further, the fuel, which exists in the vicinity of the central axis of the fuel spray injected from each of the injection holes 11, is more suppressed from being diffused from the surroundings of the central axis. On this account, as shown in FIG. 8, it is possible to further improve the penetration of the fuel spray at the high fuel injection pressure as compared with the stepped injection hole in which the cutout portion is not provided.

Figure 9:
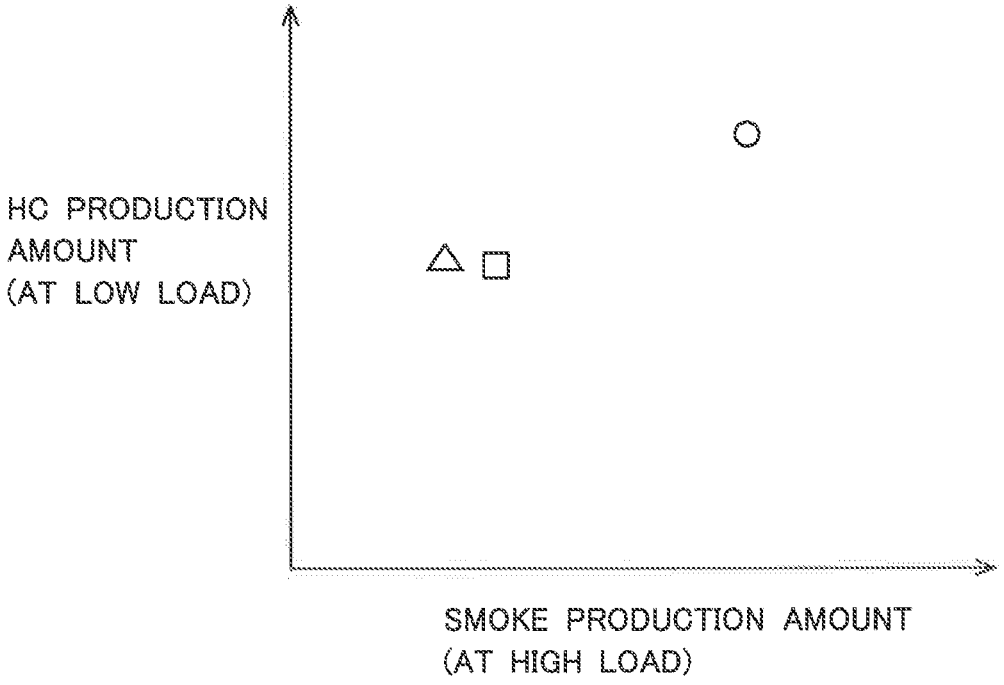
FIG. 9 shows a relationship among the construction of the injection hole of the fuel injection valve, the smoke production amount, and the HC production amount.

FIG. 9 shows a relationship among the construction of the injection hole of the fuel injection valve, the smoke production amount, and the HC production amount. In FIG. 9, the horizontal axis represents the smoke production amount during the high load operation of the internal combustion engine 1 (i.e., at the high fuel injection pressure), and the vertical axis represents the HC production amount during the low load operation of the internal combustion engine 1 (i.e., at the low fuel injection pressure). Further, the circle (○) indicates a case of the straight injection hole, the quadrangle (□) indicates a case of the stepped injection hole in which the cutout portion is not provided at the fuel outlet, and the triangle (Δ) indicates a case of the stepped injection hole according to this embodiment, i.e., the stepped injection hole in which the cutout portion is provided at the fuel outlet.

As described above, in the case of the stepped injection hole, it is possible to expand the spraying angle of the fuel spray injected from one injection hole as compared with the straight injection hole. Accordingly, the fine particle formation of the fuel is further facilitated. Further, as shown in FIG. 8, in relation to the stepped injection hole, the penetration of the fuel spray is increased at the high fuel injection pressure. The increase in the penetration of the fuel spray is suppressed at the low fuel injection pressure. Therefore, in the case of the stepped injection hole, it is possible to suppress the adhesion of the fuel to the bore wall surface during the low load operation. As a result, as shown in FIG. 9, it is possible to decrease the HC production amount during the low load operation as compared with the straight injection hole. Note that as described above, the presence or absence of the cutout portion at the fuel outlet of the stepped injection hole hardly affects the spraying angle of the fuel spray injected from each of the injection holes. Therefore, as shown in FIG. 9, the HC production amount, which is provided during the low load operation, is substantially equivalent between the stepped injection hole in which the cutout portion is not provided at the fuel outlet and the stepped injection hole according to this embodiment (stepped injection hole in which the cutout portion is provided at the fuel outlet).

Further, as described above, in the case of the stepped injection hole, it is possible to improve the penetration of the fuel spray at the high fuel injection pressure as compared with the straight injection hole. Accordingly, it is possible to improve the air utilization factor (air utilization rate) in the combustion chamber 3 during the combustion of the fuel. As a result, as shown in FIG. 9, it is possible to decrease the production amount of the smoke during the high load operation as compared with the straight injection hole. Further, as shown in FIG. 8, in the case of the stepped injection hole according to this embodiment (stepped injection hole in which the cutout portion is provided at the fuel outlet), it is possible to further raise the penetration of the fuel spray at the high fuel injection pressure as compared with the stepped injection hole in which the cutout portion is not provided at the fuel outlet. On this account, as shown in FIG. 9, in the case of the stepped injection hole according to this embodiment, the production amount of the smoke, which is provided during the high load operation, is further decreased as compared with the case of the stepped injection hole in which the cutout portion is not provided at the fuel outlet.

Figure 10:
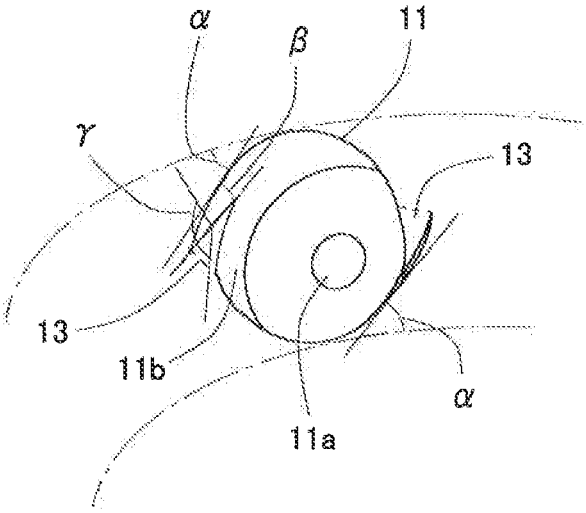
FIG. 10 shows another example of the construction of the cutout portion according to the first embodiment.

Note that in this embodiment, as shown in FIG. 10, it is also preferable that the cutout portion 13 is formed so that the angle γ, which is formed by the bottom surface and the side wall surface of the cutout portion 13, is 60 to 70 degrees. When the angle γ, which is formed by the bottom surface and the side wall surface of the cutout portion 13, is the angle which is within the range as described above, then the gas easily flows into the cutout portion 13 from the lateral position of the fuel outlet, simultaneously with which the gas, which has once flown into the cutout portion 13, hardly flows out therefrom. On this account, it is easy to incorporate a larger amount of the gas into the outlet side injection hole 11*b* at the high fuel injection pressure.

Modified Embodiment

Figure 11:
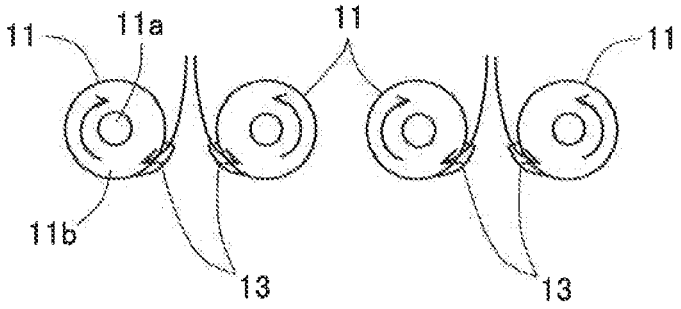
FIG. 11 shows an arrangement of cutout portions of injection holes according to a modified embodiment of the first embodiment.

In the case of the construction according to the first embodiment described above, the cutout portions 13 are provided at the two positions on the circumferential edge of the fuel outlet of the outlet side injection hole 11*b* in relation to each of the injection holes 11. However, as shown in FIG. 11, it is also appropriate to adopt such a construction that the cutout portion 13 is provided at only one position in relation to each of the injection holes 11. Also in this case, the cutout portions 13 are provided at both of mutually confronting lateral portions on the circumferential edges of the respective fuel outlets of the mutually adjoining injection holes 11. Then, all of the cutout portions 13, which are provided at the mutually confronting positions, extend in an identical direction (downward direction as viewed in FIG. 11) in relation to the upward-downward direction along the circumferential edges.

As described above, even when the cutout portion 13 is provided on only any one of the left side and the right side between which the fuel outlet is interposed along with the arrangement direction of the plurality of injection holes 11, on the circumferential edge of the fuel outlet of the outlet side injection hole 11*b*, then the swirling flow of the gas can be generated in the outlet side injection hole 11*b*, and the flow of the gas flowing in the tangential direction of the circumferential edge of the fuel outlet can be generated at the lateral position of the fuel outlet. Then, when the cutout portions 13 are provided as shown in FIG. 11, the arrangements and the shapes of the cutout portions 13 on the circumferential edges of the fuel outlets of the outlet side injection holes 11*b* of the mutually adjoining injection holes 11 are linearly symmetric, in the same manner as in the first embodiment described above. On this account, the flows of the gas flowing into the respective outlet side injection holes 11*b* are guided in the mutually opposite directions in the circumferential directions of the outlet side injection holes 11*b* by the cutout portions 13 provided respectively in relation to the mutually adjoining injection holes 11. Therefore, the inflow of the gas into the outlet side injection hole 11*b* is hardly inhibited in the same manner as in the first embodiment described above, and hence it is possible to further facilitate the inflow of the gas into the outlet side injection hole 11*b* from the lateral position of the fuel outlet.

Second Embodiment

Figure 12:
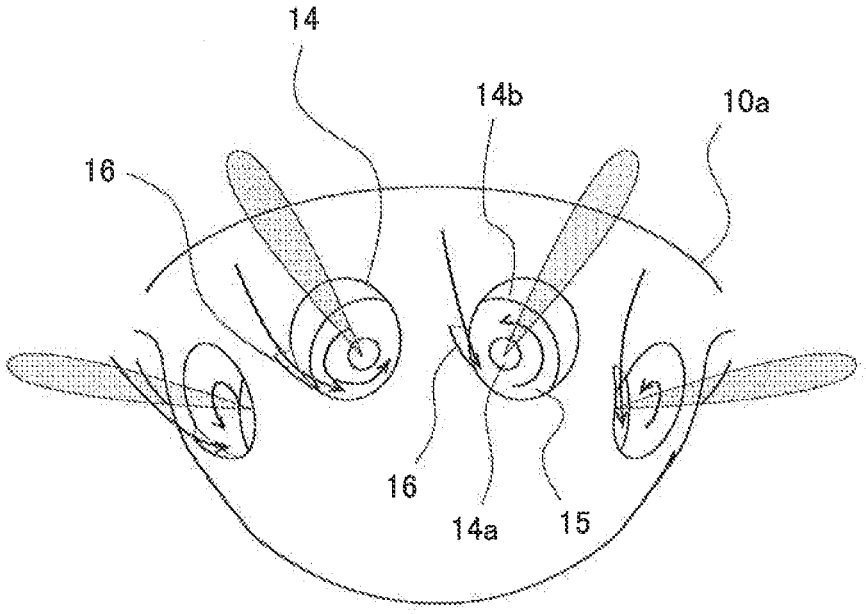
FIG. 12 shows a perspective view illustrating a forward end portion of a fuel injection valve according to a second embodiment.

FIG. 12 shows a perspective view illustrating a forward end portion of a fuel injection valve according to this embodiment. Note that in FIG. 12, the arrows indicate the flows of the gas during the fuel injection. Each of injection holes 14 of the fuel injection valve 10 according to this embodiment is a stepped injection hole in which a step (difference in diameter) is formed on a wall surface at a boundary between an inlet side injection hole 14*a* and an outlet side injection hole 14*b* so that the hole diameter of the outlet side injection hole 14*b* is larger than the hole diameter of the inlet side injection hole 14*a* in the same manner as in the first embodiment. The inlet side injection hole 14*a* is open on a step surface 15 which forms the step as the boundary between the inlet side injection hole 14*a* and the outlet side injection hole 14*b* in relation to each of the injection holes 14. Then, in this embodiment, a cutout portion 16 is provided at only one position on the circumferential edge of the fuel outlet of the outlet side injection hole 14*b* of each of the injection holes 14.

In this embodiment, as shown in FIG. 12, the cutout portion 16 is provided on the left side as viewed from the front, of the both lateral portions between which the fuel outlet is interposed along with the arrangement direction of the plurality of injection holes 14, on the circumferential edge of the fuel outlet of the outlet side injection hole 14*b*. Further, each of the cutout portions 16 extends downwardly along the circumferential edge from the central side of the lateral portion on the circumferential edge of the fuel outlet. Note that the construction of each of the cutout portions 16 themselves is the same as or equivalent to the construction of the cutout portion 11 according to the first embodiment. In other words, each of the cutout portions 16 is formed so that the width thereof is gradually decreased at positions separated farther along the circumferential edge from the central side of the lateral portion on the circumferential edge of the fuel outlet. Further, each of the cutout portions 16 is formed so that the bottom surface thereof forms an inclined surface which gradually approaches the step surface 15 of the boundary between the inlet side injection hole 14*a* and the outlet side injection hole 14*b* at positions separated farther along the circumferential edge from the central side of the lateral portion on the circumferential edge of the fuel outlet.

Also in the construction of the injection hole according to this embodiment, when the fuel injection pressure is relatively high, the gas, which exists around the fuel outlet of the outlet side injection hole 14*b* in the combustion chamber 3, is drawn into the outlet side injection hole 14*b* resulting from the pressure drop caused in the vicinity of the side wall surface in the outlet side injection hole 14*b* when the fuel is injected from the injection hole 14. Then, in this situation, the flow of the gas, which flows into the outlet side injection hole 14*b* from the lateral position at which the cutout portion 16 is provided at the fuel outlet, is guided in the circumferential direction of the outlet side injection hole 14*b* by the cutout portion 16. Accordingly, as shown in FIG. 12, the swirling flow of the gas is generated in the outlet side injection hole 14*b*. Further, the flow of the gas, which is directed in the tangential direction of the circumferential edge of the fuel outlet, is generated at the lateral position of the fuel outlet of the outlet side injection hole 14*b*. Therefore, the inflow of the gas into the outlet side injection hole 11*b* from the lateral position of the fuel outlet is facilitated in the same manner as in the case of the construction of the injection hole according to the first embodiment. Thus, it is also possible to provide the effect which is the same as or equivalent to that of the first embodiment, by using the construction of the injection hole according to this embodiment.

However, in this embodiment, when the cutout portion is provided on only any one of the left side portion and the right side portion between which the fuel outlet is interposed along with the arrangement direction of the plurality of injection holes, on the circumferential edge of the fuel outlet of the injection hole disposed on the fuel outlet side, the position thereof is disposed on only specified one side. That is, the positions, at which the cutout portions are provided, are unified by the left side portions on the circumferential edges of the fuel outlets or unified by the right side portions on the circumferential edges of the fuel outlets, in relation to all of the injection holes (in FIG. 12, the positions are unified by the left side portions on the circumferential edges of the fuel outlets). In this context, if the construction is made for the mutually adjoining injection holes such that the cutout portion is provided at the right side portion on the circumferential edge of the fuel outlet of the outlet side injection hole in relation to one injection hole and the cutout portion is provided at the left side portion on the circumferential edge of the fuel outlet of the outlet side injection hole in relation to the other injection hole, then such a portion appears that the lateral portions, at each of which the cutout portion is not provided on the circumferential edge of the fuel outlet of each of the mutually adjoining injection holes, are confronted with each other. As for the portion as described above, when the gas, which exists around the fuel outlet of the outlet side injection hole, is drawn into the outlet side injection hole during the fuel injection, the flow of the gas is not guided in the circumferential direction of the fuel outlet. On this account, the flow of the gas, which flows in the tangential direction of the circumferential edge of the fuel outlet, is not generated. As a result, the inflow of the gas into the outlet side injection hole from the lateral position of the fuel outlet is not facilitated. However, when the positions, at which the cutout portions are provided, are unified by the left side portions on the circumferential edges of the fuel outlets, or the positions are unified by the right side portions on the circumferential edges of the fuel outlets, in relation to all of the injection holes as described above, then the cutout portion is consequently provided at any one of the respective lateral portions on the circumferential edges of the fuel outlets of the mutually confronting outlet side injection holes in relation to the mutually adjoining injection holes. On this account, it is possible to avoid the occurrence of such a state that the flow of the gas flowing into the outlet side injection hole is not guided in the circumferential direction of the fuel outlet at any one of the respective lateral portions on the circumferential edges of the fuel outlets of the mutually confronting outlet side injection holes in relation to the mutually adjoining injection holes. Therefore, the inflow of the gas into the outlet side injection hole from the lateral position of the fuel outlet can be facilitated at a preferred balance. Thus, it is possible to more appropriately improve the penetration of the fuel spray when the fuel injection pressure is relatively high.

Modified Embodiment

Figure 13:
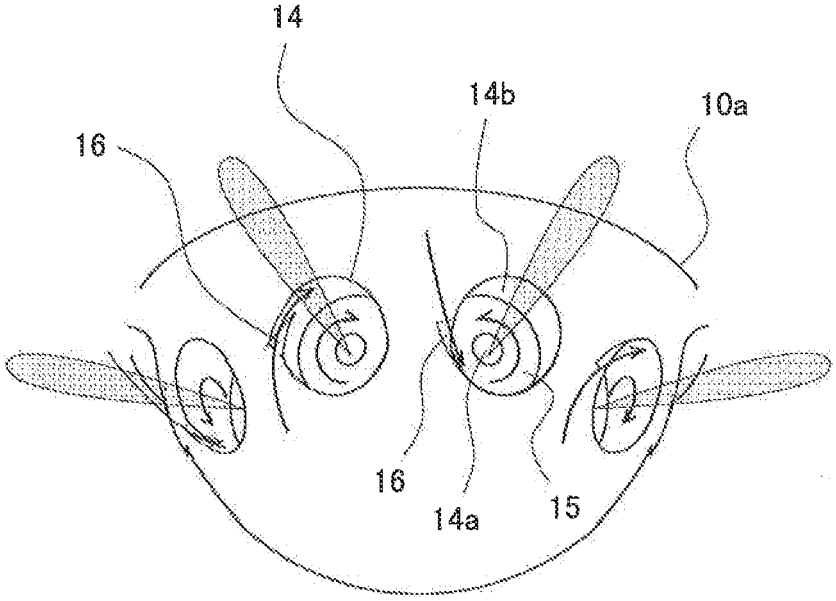
FIG. 13 shows a perspective view illustrating a forward end portion of a fuel injection valve according to a modified embodiment of the second embodiment.

Note that when the cutout portion is provided at any specified one of the left side portion and the right side portion on the circumferential edge of the fuel outlet of the fuel outlet side injection hole, it is also allowable that the direction, in which the cutout portion extends along the circumferential edge of the fuel outlet, is not unified. For example, as shown in FIG. 13, the following construction is also available. That is, the positions, at which the cutout portions 16 are provided, are unified by the left side portions on the circumferential edges of the fuel outlets, while the injection holes 14 in each of which the cutout portion 16 extends downwardly along the circumferential edge from the central side of the lateral portion on the circumferential edge of the fuel outlet and the injection holes 14 in each of which the cutout portion 16 extends upwardly along the circumferential edge from the central side of the lateral portion on the circumferential edge of the fuel outlet are arranged while being alternately aligned.

Other Embodiments

In the present invention, it is not necessarily indispensable that the cutout portions as described above should be provided for all of the plurality of stepped injection holes provided for the fuel injection valve. For example, when it is necessary for some of the injection holes to increase the penetration of the fuel spray at the high fuel injection pressure as compared with the other injection holes, it is also allowable that the cutout portions are provided on only the circumferential edges of the fuel outlets of the some of the injection holes.

Further, it is also possible to adopt the following construction for a fuel injection valve having a plurality of stepped injection holes. That is, the cutout portions are provided at both of the lateral portions on the circumferential edge of the fuel outlet as in the first embodiment in relation to some of the injection holes, and the cutout portion is provided at any one of the left side portion and the right side portion on the circumferential edge of the fuel outlet as in the second embodiment in relation to some of the other injection holes.

Further, the shape of the cutout portion according to the present invention is not limited to the shapes of the cutout portions 13, 16 of the first and second embodiments described above, provided that the flow of the gas flowing into the outlet side injection hole from the lateral position of the fuel outlet can be guided in the circumferential direction of the outlet side injection hole.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-227314, filed on Nov. 7, 2014, which is hereby incorporated by reference herein in its entirety.

REFERENCE SIGNS LIST

1: internal combustion engine
2: cylinder
10: fuel injection valve
10*a*: main nozzle body
11, 14: injection hole
11*a*, 14*a*: inlet side injection hole
11*b*, 14*b*: outlet side injection hole
12, 15: step surface
13, 16: cutout portion

What is claimed is:

1. A fuel injection valve for injecting fuel into a cylinder of an internal combustion engine, comprising:

a plurality of injection holes aligned on a circumference at a forward end portion of a main nozzle body, the plurality of injection holes each having an inlet side injection hole and an outlet side injection hole;

wherein one or more of the plurality of injections holes have:

a step which is formed on a wall surface at a boundary between the respective inlet side injection hole and the respective outlet side injection hole so that a hole diameter of the respective outlet side injection hole is larger than a hole diameter of the respective inlet side injection hole, and a cutout portion, which guides a flow of gas flowing into the respective outlet side injection hole from a lateral position of a fuel outlet of the respective outlet side injection hole during fuel injection in a circumferential direction of a corresponding circumferential edge of the respective outlet side injection hole, being provided for on at least one of two lateral portions between which the fuel outlet is interposed along with an arrangement direction of the plurality of injection holes, on the corresponding circumferential edge of the respective outlet side injection hole, in relation to at least some of the injection holes, wherein the cutout portion extends clockwise or counterclockwise along the corresponding circumferential edge from a central side of a lateral portion of the corresponding circumferential edge of the respective fuel outlet of the respective outlet side injection hole, and the cutout portion is formed so that a respective lateral width thereof is gradually decreased at positions separated farther from the circumferential edge from the central side of the lateral portion on the corresponding circumferential edge of the respective fuel outlet and a bottom surface thereof forms an inclined surface which gradually approaches a step surface of the boundary between the respective inlet side injection hole and the respective outlet side injection hole at positions separated farther along the corresponding circumferential edge from the central side of the lateral portion on the corresponding circumferential edge of the respective fuel outlet.

2. The fuel injection valve according to claim 1, wherein:

cutout portions are provided for both of mutually adjoining injection holes; and the cutout portions, which are provided for the mutually adjoining injection holes respectively, are formed so that the flows of the gas flowing into the respective outlet side injection holes during the fuel injection are guided in mutually opposite directions in the circumferential directions of the outlet side injection holes.

3. The fuel injection valve according to claim 1, wherein:

cutout portions are provided for two mutually confronting lateral portions on the circumferential edges of the respective fuel outlets of mutually adjoining injection holes; and the cutout portions, which are provided for the mutually adjoining injection holes respectively, extend in an identical direction along the circumferential edges from the central sides of the lateral portions of the circumferential edges of the fuel outlets.

4. The fuel injection valve according to claim 1, wherein:

cutout portions are provided for two mutually adjoining injection holes; and the cutout portion is provided on any specified one of a left side and a right side between which the fuel outlet is interposed along with the arrangement direction of the plurality of injection holes, on the circumferential edge of the fuel outlet of the outlet side injection hole in relation to each of the mutually adjoining injection holes.

* * * * *